US006453824B1

(12) United States Patent
Dobbins

(10) Patent No.: US 6,453,824 B1
(45) Date of Patent: Sep. 24, 2002

(54) SKI LIFT RADIO

(76) Inventor: Richard Dobbins, 3146 Vinings Ridge Dr., Atlanta, GA (US) 30339

( * ) Notice: Subject to any disclaimer, the term of this patent is extended or adjusted under 35 U.S.C. 154(b) by 0 days.

(21) Appl. No.: 09/863,602

(22) Filed: May 24, 2001

Related U.S. Application Data

(60) Provisional application No. 60/233,023, filed on Sep. 15, 2000, and provisional application No. 60/250,650, filed on Dec. 1, 2000.

(51) Int. Cl.[7] ..... B61B 11/00
(52) U.S. Cl. ..... 105/149.1
(58) Field of Search ..... 105/148, 149.1, 105/149.2; 104/89

(56) References Cited

U.S. PATENT DOCUMENTS 4,327,648 A * 5/1982 Anton ..... 105/150
4,868,887 A * 9/1989 Bertrand ..... 455/41

* cited by examiner

*Primary Examiner*—S. Joseph Morano
*Assistant Examiner*—Robert J. McCarry, Jr.
(74) *Attorney, Agent, or Firm*—Rodgers & Rodgers

(57) ABSTRACT

According to this invention, a ski lift radio is provided whereby data are stored electronically and converted to an audio signal to be played by the radio and wherein the system is charged by means of an inductive charge receptor associated with the radio which is charged by means of a stationary inductive charger.

6 Claims, 2 Drawing Sheets

SKI LIFT RADIO

The benefits under 35 U.S.C. 119 are claimed of provisional applications No. 60/233,023 filed Sep. 15, 2000, AND 60/250,650 filed Dec. 1, 2000.

BACKGROUND OF THE INVENTION

The growing popularity of skiing in recent years has resulted in the proliferation of a large number of ski resorts having multiple ski lifts to transport large numbers of skiers by means of chairs or gondolas. During the ski lift ride, the ski resort has, in effect, a captive audience for the several minutes that a skier is on the lift or gondola. Therein arises the opportunity to provide audio entertainment, information and advertising via individual radios mounted on each chair or in the gondola.

BRIEF SUMMARY OF THE INVENTION

By this invention, a ski lift radio is provided wherein data are transmitted and electronically stored and then converted to an audio signal to be played by means of a radio associated with each ski lift chair or gondola. The system is charged by means of an inductive charge receptor mounted on each chair apparatus and adapted to cooperate with a stationary inductive charger disposed in close proximity to the ski lift.

DETAILED DESCRIPTION OF THE INVENTION

Figure 1:
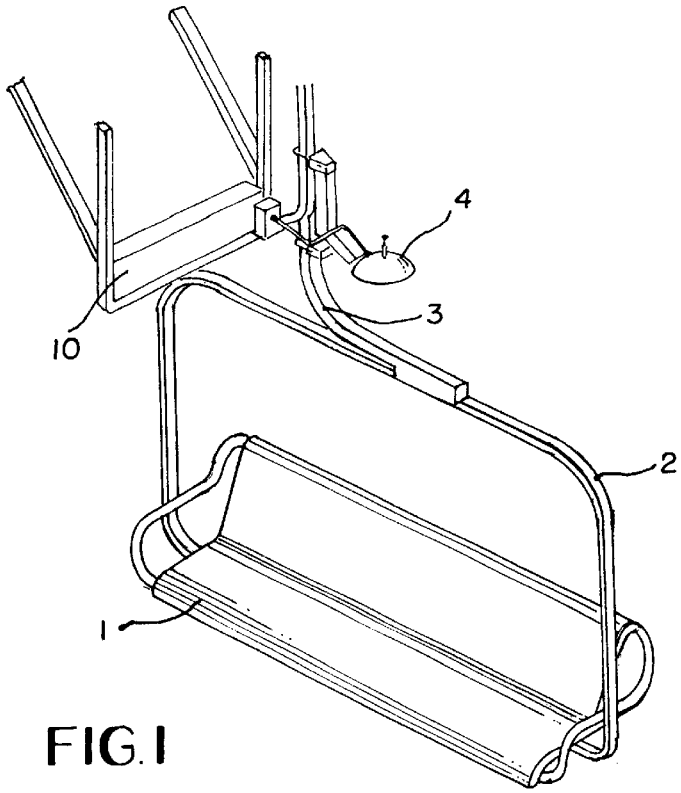
FIG. 1 is a perspective view of a ski lift chair with the radio and associated apparatus according to this invention mounted thereon.
Figure 2:
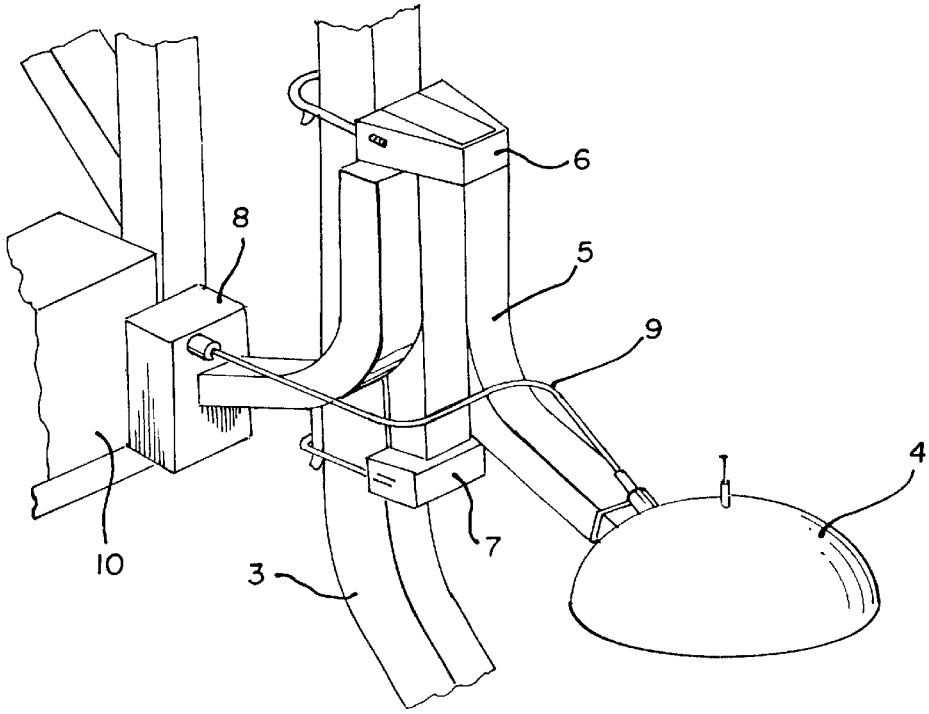
FIG. 2 is an enlarged perspective view of the radio and associated apparatus.

In the drawings and with particular reference to FIG. 1, the numeral 1 designates a conventional ski lift chair secured to chair frame 2. Chair 1 is attached to the overhead moving conveyor (not shown) by means of arm 3 which is attached to the overhead cable at one end thereof and to chair frame 2 at the other end thereof.

Radio 4 is attached to arm 3 by means of mounting bracket 5 and associated clamps 6 and 7, as is well known. To complete the basic elements of the ski lift radio according to this invention, radio 4 is interconnected to inductive charge receptor 8 by means of wire 9. Inductive charger 10 is mounted on any suitable fixed structure located adjacent the ski lift.

In operation, as receptor 8 passes by charger 10, magnetic coupling is used to transfer energy over the short space between the two. Receptor 8 includes a lithium-ion or recombinant lead acid-type battery. By this means, the system is kept constantly charged in a wireless manner.

Figure 3:
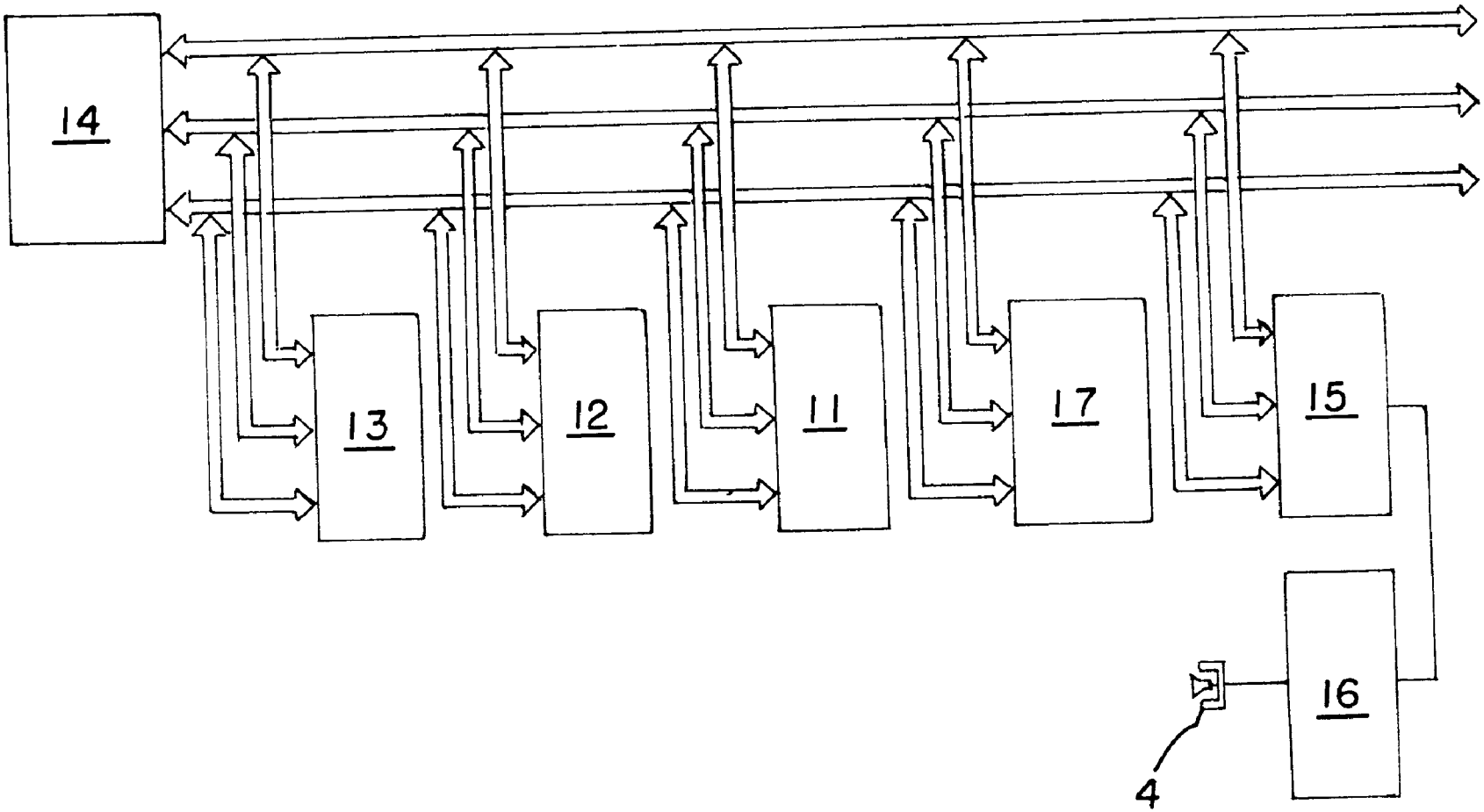
FIG. 3 is a schematic representation of the circuitry in accordance with this invention.

In FIG. 3, the system is shown schematically wherein data are stored in memory and then converted to audio. More specifically, data are fed from a transmitter located at the lift station into the memory function of radio 4 via a direct memory access (DMA) circuit 11 which allows for the rapid loading of data during the short time period the chair is at the lift station. Audio data are stored in RAM 12 while the program data to operate the radio are stored in ROM 13. Controller 14 will control the system and digital to analog converter (DAC) 15 converts digital signals to audio signals which are then amplified by means of amplifier 16 and fed to the internal speaker of radio 4. Real time clock 17 is used to activate time-sensitive announcements as desired.

In operation, data are transmitted in approximately a fifteen second span which requires a radio which can transmit at a rate of under 2 megabits per second. For this purpose, a 2.4 GHz link, operating under FCC part 15 rules or, alternatively, a 900 MHz part 15 link is used. In order for the radio to begin playing as the chair leaves the lift station, the radio is triggered and the program starts once the radio is no longer receiving power from the inductive charging system. When the program ends, the radio ceases functioning thereby conserving power until it begins a new cycle at the charging station.

What is claimed is:

1. A ski lift radio comprising skier transportation apparatus, said apparatus movable by means of an overhead conveyor system, a radio attached to said apparatus, an inductive charge receptor interconnected to said radio, an inductive charger mounted on a fixed structure adjacent the path of said apparatus, and as said receptor moves into close proximity to said charger energy is transferred to said receptor by means of magnetic coupling.

2. A ski lift radio according to claim 1 wherein said apparatus is a ski lift chair.

3. A ski lift radio according to claim 1 wherein said apparatus is a gondola.

4. A ski lift radio according to claim 1 wherein audio data are stored in said radio by random access memory means.

5. A ski lift radio according to claim 1 wherein program data are stored in said radio by read only memory means.

6. A ski lift radio according to claim 1 wherein digital signals are converted to audio signals by means of a digital to analog converter associated with said radio.

* * * * *